United States Patent [19]

Schreyer

[11] 4,097,024

[45] Jun. 27, 1978

[54] HAND HOIST/PULLER OPERATING HANDLE/LEVER

[75] Inventor: Kenneth D. Schreyer, Clarence, N.Y.

[73] Assignee: Columbus McKinnon Corporation, Tonawanda, N.Y.

[21] Appl. No.: 619,595

[22] Filed: Oct. 6, 1975

[51] Int. Cl.[2] ..... B66D 1/00

[52] U.S. Cl. ..... 254/169; 74/523

[58] Field of Search ..... 254/169, 73–79, 254/164, 163, 161, 167; 74/543, 545, 523, 524; 81/52.4 R

[56] References Cited

U.S. PATENT DOCUMENTS

| | | | |
|---|---|---|---|
| 2,154,762 | 4/1939 | McGregor et al. | 254/79 |
| 2,222,162 | 11/1940 | Adamson | 254/79 |
| 2,287,551 | 6/1942 | Coffing | 254/167 |
| 2,741,927 | 4/1956 | Hollander | 254/167 |
| 2,770,339 | 11/1956 | Dotson | 254/167 |
| 3,283,620 | 11/1966 | Bailey | 81/52.4 R |
| 3,311,348 | 3/1967 | Taylor | 254/74 |
| 3,597,995 | 8/1971 | Hawkins | 74/523 |
| 3,707,885 | 1/1973 | Profet | 74/543 |

*Primary Examiner*—Trygve M. Blix
*Assistant Examiner*—Kenneth Noland

[57] ABSTRACT

A side lever type handle for hand operated tensioning devices, such as hoist or puller mechanisms, which is adapted to 360° rotation operation; said handle being reverse-curve contoured so as to minimize torsional moments acting to rotate the hoist/puller mechanism about the axis of the load system incidental to pushing-/pulling upon the handle. Optionally, the handle may be sectionally designed to complement its aforesaid contour so as to adapt it to yield plastically in torsion and bending in response to attempts to overload the associated mechanism.

3 Claims, 9 Drawing Figures

HAND HOIST/PULLER OPERATING HANDLE/LEVER

BACKGROUND OF THE INVENTION

Hand operated hoist or puller mechanisms of the prior art typically employ side lever handles of straight cantilever type "beam" configurations as viewed from all angles, so as to simplify their construction and maximize their rigidity against bending under overload, and load transfer capabilities. Such lever handles are necessarily connected to the driving device of the associated hoist/puller mechanisms at positions distantly offset from the load system center line, and therefore extend therefrom in straight line configurations parallel to the load system center line, whereby they impose (when being operated) torsional moments acting upon the associated hoist mechanism which tend to rotate the latter about the axis of the load system; thereby interfering with the operator's efficient use of the system. Such hoist/puller mechanisms typically include ratchet and/or brake devices operating to "hold" the load between strokings of the handle/lever; and typical prior art hoist/puller mechanisms and lever-handle arrangements therewith are referred to by way of example as disclosed in U.S. Pat. Nos. 2,242,361; 2,519,400; 2,681,204; 3,597,995 and 3,722,316.

The present invention reduces the mechanical advantage through which lever/handle operations impose torsional moments tending to rotate the hoist/puller mechanism about the axis of the load system. Furthermore, the novel configuration of the lever/handle of the present invention may be utilized to cause it to plastically "give" and deform in novel manner whenever the operator attempts to overload the associated hoist/puller mechanism; thereby signalling the operator and inducing an instinctive relaxation of his pressure on the handle. Thus, the lever device of the present invention may also be employed to provide (for a hoist/puller mechanism) an overload prevention capability device; the utility of such being explained for example in U.S. Pat. Nos. 3,597,995 and 3,722,316.

THE DRAWING

FIG. 1 of the drawing herewith illustrates in perspective an otherwise typical hand-operated hoist or puller mechanism and its attendant load chain assembly, to which is operatively coupled a lever type handle of the present invention;

Figure 3:
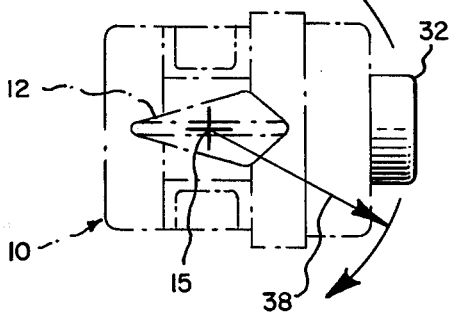
FIG. 3 is a top plan view of a conventional hoist/puller mechanism such as shown in FIG. 2; illustrating how the rotational force couples incidental to operations of handle/levers of conventional form act through relatively large amount arms to twist the associated hoist/puller mechanism about the center line of the load transfer system.
Figure 4:
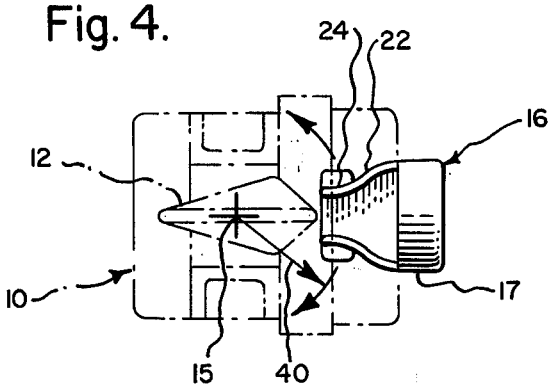
Figure 5:
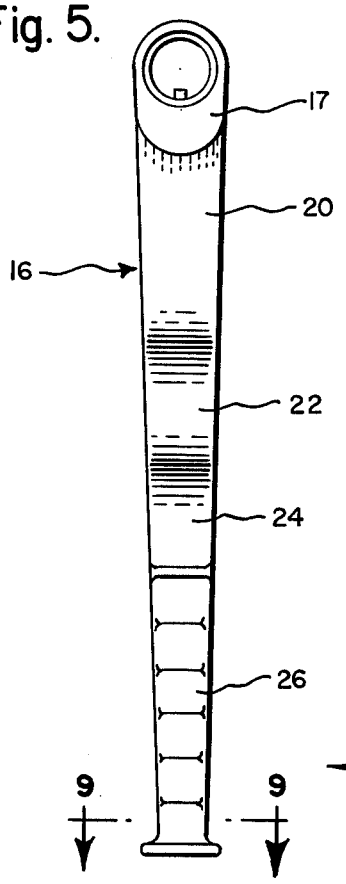
Figure 6:
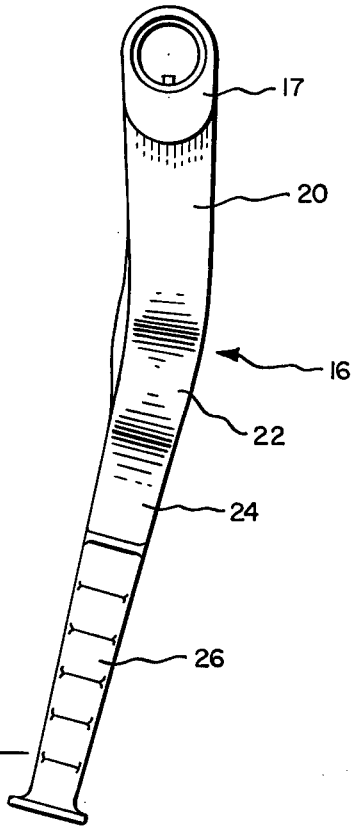
Figure 7:
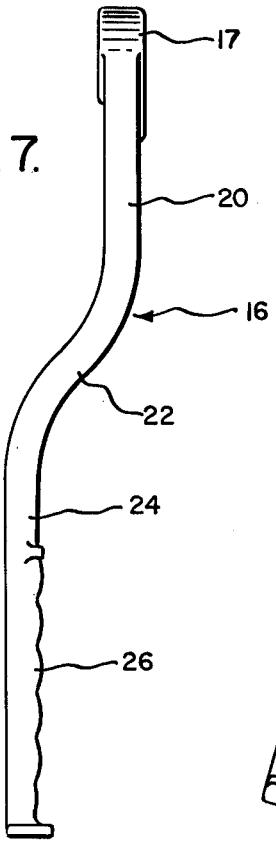
Figure 8:
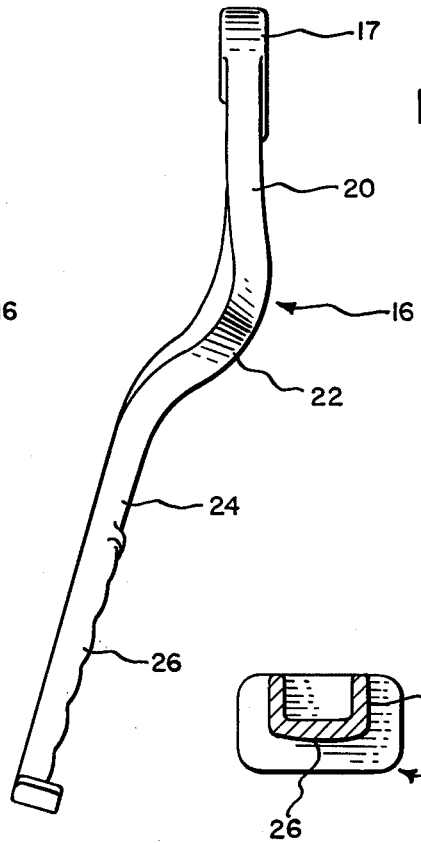
Figure 9:
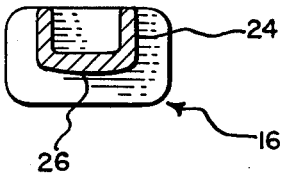

FIG. 4 corresponds to FIG. 3 but illustrates by comparison therewith how the improved handle/lever of the present invention operates through a substantially lesser moment arm;

FIG. 5 illustrates in side elevation a handle/lever of the present invention when in its normal configuration;

FIG. 6 corresponds to FIG. 5 but illustrates how the handle/lever of the present invention plastically deforms in side elevation whenever the operator attempts to overload the associated hoist/puller mechanism;

FIG. 7 is a front elevational view of the handle/lever as shown in FIG. 5;

FIG. 8 is a view corresponding to FIG. 7, but shows the handle/lever in plastically deformed condition resulting from an attempt to overload the associated hoist/puller mechanism; and FIG. 9 is a sectional view taken as indicated at 9—9 of FIG. 5, further illustrating the sectional form of the handle/lever member.

DETAILED SPECIFICATION

Figure 1:
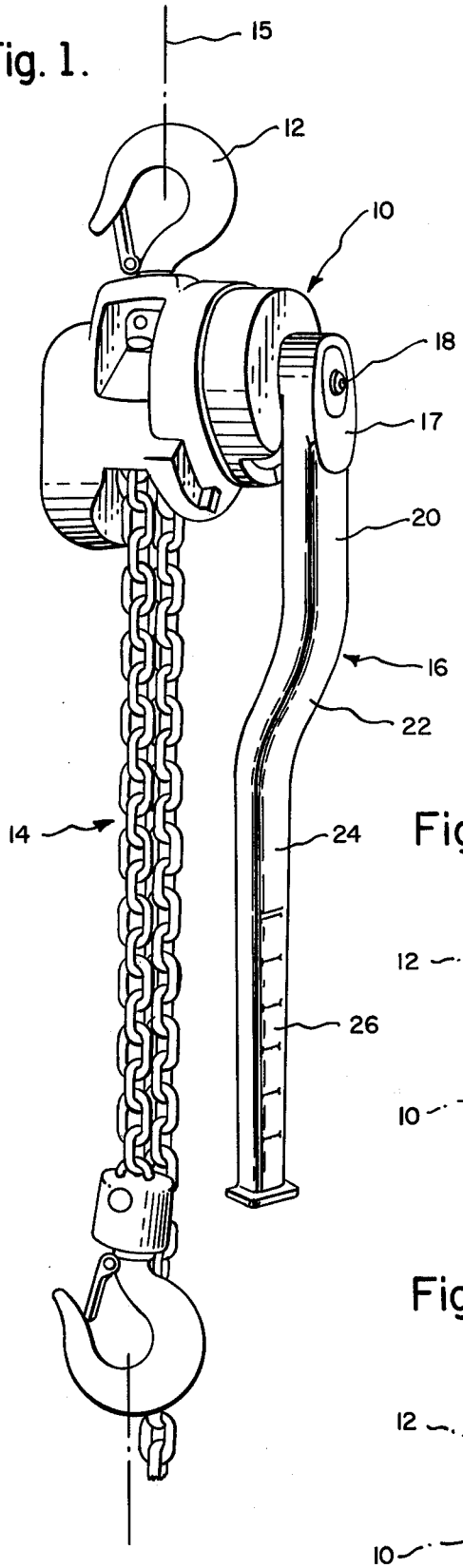

As illustrated at FIG. 1 a typical hoist/puller mechanism as used in industry is indicated at 10, and is shown as including a standard type suspension hook (or other "reaction") device 12, and suspends therebelow a load chain 14; thereby defining a "load system" acting about a "center line" as shown at 15. FIG. 1 also illustrates the hoist/puller mechanism as being equipped with an operating handle/lever 16 of the present invention; the lever 16 being attached at its "butt" portion 17 to the drive mechanism of the hoist/puller as by means of a nut/bolt device or the like as indicated at 18. It is to be particularly noted that the handle lever 16 of the present invention is reverse-curve configured as viewed in FIGS. 1, 7, whereby the lever includes a mounting hub or "butt" portion 17 subtended by a laterally straight portion 20 which clears the mechanism 10 when operated; a reverse-curved elbow portion 22; and a straight arm portion 24 terminating in a handle cuff portion 26.

Thus, the lateral arm portion 20 which of necessity connects through the hub portion 17 to the driver of the mechanism 10 at a substantially offset position relative to the center line 15 of the load system (FIGS. 1–4) "clears" the mechanism 10 incidental to "stroking" or 360° rotation operations of the handle. However, it is to be particularly noted that the configuration of the reverse-curved elbow portion 22 of the handle causes the moment arm through which the lever handle 26 operates to be displaced substantially inwardly toward the load system center line 15; thereby substantially reducing the moment arm relative to the load system center line through which the lever of the present invention imposes torsional couples on the hoist/puller mechanism.

Figure 2:
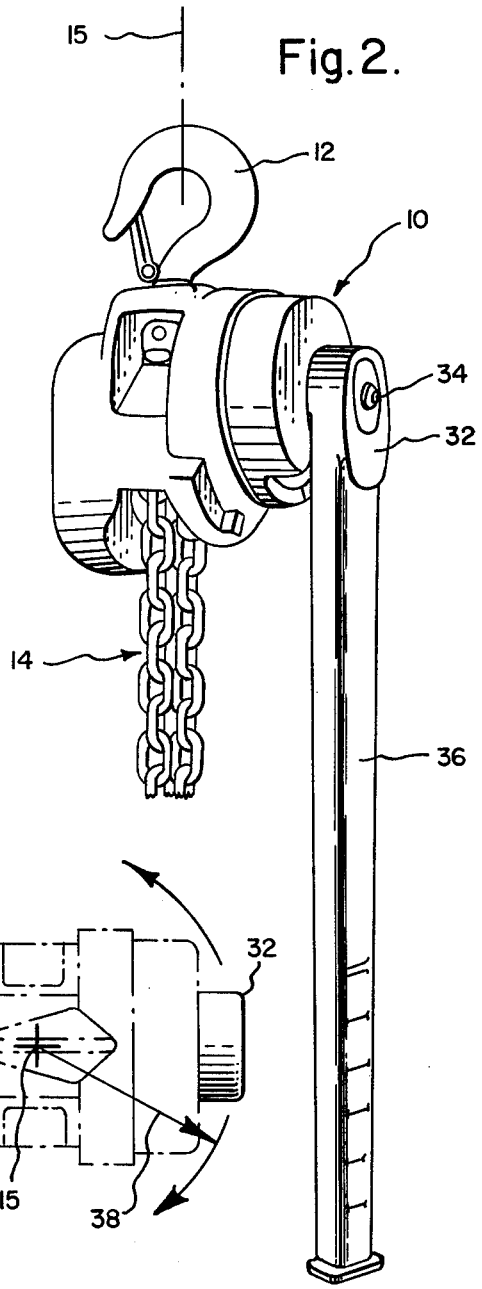
FIG. 2 shows by comparison to FIG. 1 the provision of a typical hoist/puller lever handle according to the prior art.

FIG. 2 of the drawing herewith depicts a conventional type handle/lever for such purposes, wherein the lever includes a hub portion 32 adapted for connection as indicated at 34 to the hoist/puller drive mechanism, as explained in connection with FIG. 1. However, inasmuch as such prior art handle/levers subtend from the hub portion 32 in straight line configuration as illustrated at 36 it will be appreciated that stroking/rotation operations of the handle/lever 36 will impose upon the hoist mechanism 10 torsional couples relative to the load system center line acting through moment arms of such magnitude as is indicated at 38, (FIG. 3). In the case of the present invention the handle/lever acts through a substantially reduced moment arm of an order such as is indicated at 40 (FIG. 4). Therefore, it will be appreciated that incidental to push-pull stroking or rotation actuations of the handle/lever 24, the torsional couples imposed upon the hoist mechanism act through substantially lesser moment arms.

As illustrated by FIGS. 5–9, the handle/lever of the present invention may be beneficially designed and fabricated of such material as to be adapted to plastically deform in the area of its reverse-bent elbow region 22, if and whenever the operator attempts to overload the associated hoist/puller mechanism. Incidentally, the curved elbow portion 22 is sectionally dimensioned thereat and so formed of such material as to render it plastically deformable whenever overloaded, such as shown for example into the configurations illustrated by FIGS. 6, 8. It will of course be understood that the occurrence of any such plastic deformation of the handle will be immediately sensed by the operator of the device, whereupon he will instinctively relax his loading on the handle. Thus, the hoist mechanism per se is protected against overload, and in event the handle/-lever is thereby substantially deformed it would be necessary only to replace the handle/lever per se, thereby restoring the hoist/puller mechanism to its original capabilities.

I claim:

1. A hoist/puller unit comprising in combination:

a load pull mechanism comprising a body having an anchoring means on one side thereof, a flexible tension member issuing from the other side of said body and adapted for connection to a load, and drive mechanism for applying tension to said tension member thereby defining a load system having a center line which extends longitudinally of said tension elements and passes through said body to said anchoring means, said drive mechanism being rotatable in said body about an axis which extends generally perpendicular to said center line;

a handle for operating said drive mechanism, said handle including a first portion connected to said drive mechanism in offset, spaced relation to said center line, a hand-operated end portion extending substantially parallel to said center line and spaced more closely thereto than is said first portion, and a reverse-curved portion joining said first portion to said hand-operated end portion;

said reverse-curved portion being formed of plastically deformable material whereby said hand-operated end will twist when the handle is subjected to an overload in order to apprise an operator of such overload and upon such twisting said hand-operated end portion displaces towards said center line which further apprises the operator of such overload.

2. A hoist/puller unit as set forth in claim 1, wherein said reverse-curved elbow portion is U-shaped in cross-section.

3. A hoist/puller unit as defined in claim 1 wherein said hand-operated end portion of the handle is offset relative to said first portion of the handle such that said handle-operated end lies wholly to one side of and spaced inwardly from said first portion.

* * * * *